US005190593A

United States Patent [19]

Kurzinski

[11] Patent Number: 5,190,593

[45] Date of Patent: Mar. 2, 1993

[54] APPARATUS AND METHOD FOR CLEANING THE OUTSIDE OF THE MOLD TUBE IN A CONTINUOUS CASTING MACHINE

[76] Inventor: Cass R. Kurzinski, 120 Julian Plz., Syracuse, N.Y. 13210

[21] Appl. No.: 658,731

[22] Filed: Feb. 21, 1991

[51] Int. Cl.[5] ..... B22D 11/124; C23G 1/02

[52] U.S. Cl. ..... 134/3; 134/28; 134/41; 164/158; 164/443; 164/485

[58] Field of Search ..... 164/485, 443, 348, 158, 164/121; 134/3, 28, 41

[56] References Cited

U.S. PATENT DOCUMENTS

| | | | |
|---|---|---|---|
| 3,041,686 | 7/1962 | Hazelett et al. | 164/443 X |
| 3,369,935 | 2/1968 | Booth et al. | 134/28 X |
| 3,987,841 | 10/1976 | Itoh et al. | 164/158 |
| 3,996,062 | 12/1976 | Frost et al. | 134/41 X |

FOREIGN PATENT DOCUMENTS

| | | | |
|---|---|---|---|
| 2135365 | 1/1973 | Fed. Rep. of Germany | 164/158 |
| 55-158854 | 12/1980 | Japan | 164/485 |
| 62-110839 | 5/1987 | Japan | 164/485 |
| 2-30354 | 1/1990 | Japan | 164/485 |

*Primary Examiner*—J. Reed Batten, Jr.
*Attorney, Agent, or Firm*—Dennis H. Lambert

[57] ABSTRACT

An apparatus and method for cleaning the precipitate from the outside of a mold tube in a metal casting machine, includes spray nozzles positioned around the mold tube for spraying a chemical solution against the tube, in situ, to dissolve precipitate thereon, thus avoiding the necessity of removing the mold tube from the machine or otherwise shutting down the casting operation. In spray cooled machines, the water used to cool the mold tube can be used to rinse away the solution and dissolved precipitate.

15 Claims, 2 Drawing Sheets

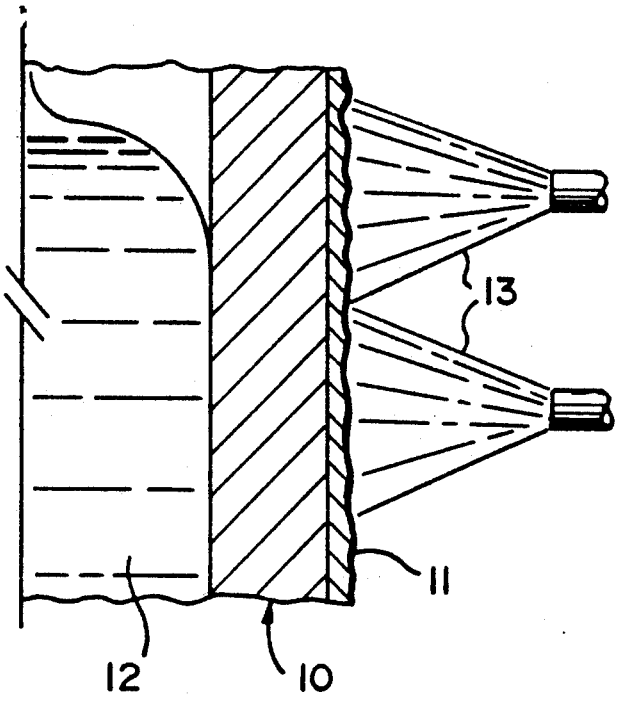
FIG. 1
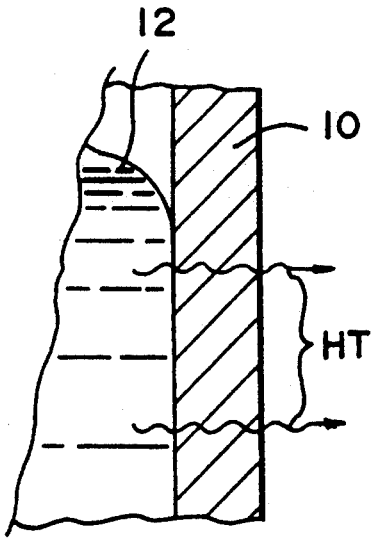
FIG. 2
FIG. 3
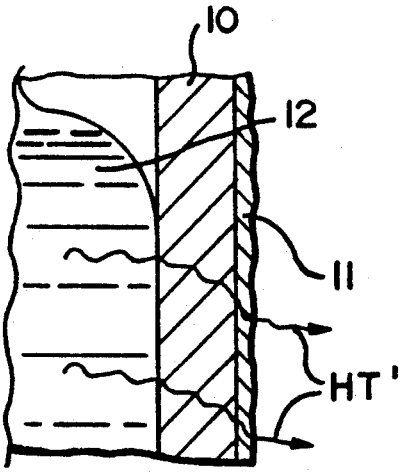
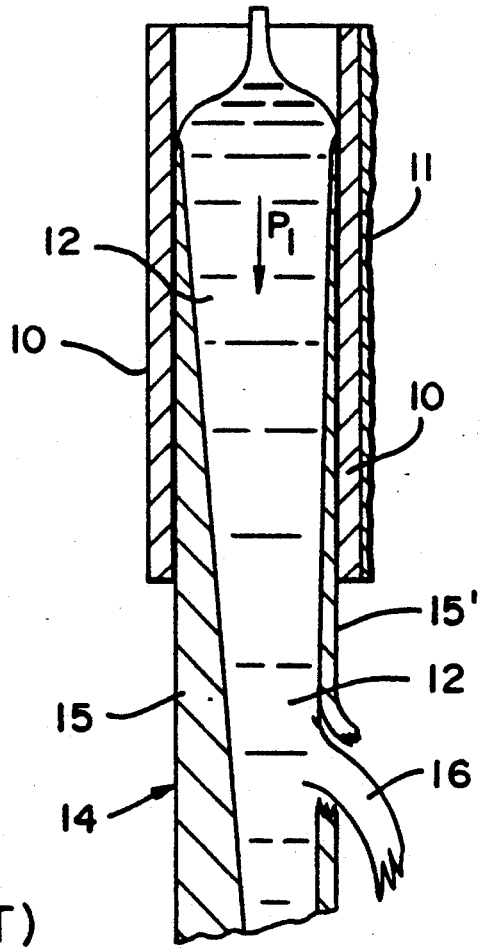
FIG. 4
(PRIOR ART)

APPARATUS AND METHOD FOR CLEANING THE OUTSIDE OF THE MOLD TUBE IN A CONTINUOUS CASTING MACHINE

FIELD OF THE INVENTION

This invention relates to high temperature metal continuous casting machines, and more particularly, to an apparatus and method for cleaning precipitates from the outside of the mold tube without requiring removal of the mold tube from the mold.

BACKGROUND OF THE INVENTION

In conventional continuous steel casting machines, molten steel is passed through a generally vertically oriented copper mold tube to form a cast steel strand or slab. The temperature of the molten steel is typically about 2850° F., although with certain grades of metal the temperature may be as low as 2600° F. In general, although most of the references herein are to steel casting, the invention contemplates the casting of any metal or metal alloy whose liquid temperature exceeds about 2600° F. As the molten steel passes through the mold tube, its outer shell hardens. The hardened outer shell confines the molten steel core of the cast strand while the strand continues to cool and solidify following its exit from the mold tube.

The mold which forms the steel strand contains the liquid steel and provides for its initial solidification, that is, hardening of the outer shell. The solidifying strand is extracted continuously from the bottom of the mold at a rate equal to that of the incoming liquid steel at the top, the production rate of the mold being determined by the time required for the outer shell to harden sufficiently so as to contain the inner core of liquid steel as the strand exits the mold tube.

The mold tube and thus the liquid steel flowing therethrough are preferably cooled with sprays of coolant water directed against the outside of the mold tube during a casting operation. Since industrial water systems used for cooling purposes nearly always contain various amounts of minerals dissolved in solution, and since the mold tubes are very hot, when the coolant water comes into contact with the hot mold tube surface, some of the minerals in the water will precipitate onto the mold tube surface. The minerals most commonly present in the coolant water are compounds of calcium and magnesium.

This precipitate layer will build up over a period of time and act as an insulating barrier to heat transfer from the molten metal and into the coolant water being sprayed against the mold tube. A layer of precipitate as thin as 0.003 inch will reduce the rate of heat transfer through the mold tube wall by about 50–75%. The net effect of this reduced heat transfer rate is that the thickness of the solidifying steel shell will be markedly reduced, often resulting in the shell being too thin to support the ferrostatic pressure of the core of liquid steel as the cast strand leaves the mold tube. This thin shell can rupture (commonly referred to as a "break-out"), allowing molten steel to spill out, thereby causing considerable damage to machinery and creating a dangerous condition for machine operators. Poor steel quality also results.

The adhering strength of the precipitate layer to the mold tube wall is directly related to the temperature of the copper mold tube wall and the length of time that the precipitate layer remains undisturbed on the mold tube. It is thus desirable to clean the precipitate layer from the mold tube wall as quickly as practical after its formation, and preferably while the mold tube wall is still warm (about 210° F.).

However, in conventional mold assemblies it is not possible to meet these conditions, since the mold tube wall is normally not accessible without disassembling the mold and removing the mold tube for cleaning outside of the machine. Because this is an expensive and time-consuming proposition, cleaning typically only takes place when the precipitate layer has built up and heat transfer through the mold tube wall has deteriorated to an unacceptable level. This, of course, increases the danger of a "break-out", slows production, and reduces the quality of the cast metal.

Moreover, since the design of a conventional continuous casting mold requires that a baffle tube be placed in close proximity to the cooling mold tube, it is not possible for the machine operators to visually inspect the mold for precipitate build-up without completely disassembling the mold and removing the copper mold tube. After the mold tube has been disassembled from a conventional mold, the tube is typically subjected to a grinding or polishing operation to remove the precipitate layer. This polishing operation can only be accomplished during a shutdown of operations and requires expensive labor and costly down-time in the steel plant.

There is thus need for a means and method to clean the precipitate from a mold tube in a continuous casting machine, without requiring disassembly of the mold.

SUMMARY OF THE INVENTION

Accordingly, it is an object of the present invention to provide an apparatus and method for cleaning the precipitate from the mold tube in a continuous casting machine, without requiring disassembly of the mold.

Another object of the invention is to provide an apparatus for cleaning the precipitate from a spray-cooled mold tube of a continuous casting machine, without requiring shut-down of the casting machine or removal of the mold tube from the mold.

A further object is to provide an apparatus and method for cleaning the precipitate from a spray-cooled mold tube in a continuous casting machine, without requiring disassembly or shut-down of the mold and which is capable of cleaning the tube even during a casting operation.

A still further object is to provide a means for spraying a chemical onto the precipitate layer which builds up on the outside of the mold tube in a continuous casting machine, to dissolve the precipitate layer without requiring removal of the mold tube from the mold.

These and other objects and advantages of the invention are accomplished by providing spray means adjacent the mold tube for spraying a chemical solution against the mold tube to dissolve any precipitate deposited thereon. The chemical will usually comprise an acidic solution, such as muriatic acid, although the composition of the chemical depends upon the nature of the precipitate layer being dissolved. Thus, it is to be understood that even though an "acidic" solution is referred to throughout this application, the solution can actually be basic in nature, depending upon the composition of the precipitate, and both are intended to be covered. Both acidic and basic solutions have been employed, and the parameters referred to hereinafter apply to either type of solution.

Cleaning of precipitate from the mold tube as described above is best accomplished in a spray-cooled mold, which utilizes sprays of coolant water directed against the mold tube to cool it and extract heat from the metal being cast therein. The means for spraying the precipitate-dissolving chemical solution can comprise a plurality of spray nozzles arranged alongside the mold tube in predetermined spaced relationship to one another and to the tube.

Applicant has discovered that the pressure under which the solution is sprayed, the spray angle, spacing of spray nozzles, temperature of the mold tube, concentration of the chemical solution, and retention time of the solution on the precipitate layer must all be selected in a critical range or cleaning of the precipitate from the mold tube cannot be properly accomplished. For instance, failure to utilize appropriate spray pressures and/or spray angles can result in contamination of the entire cooling water system, and can cause chemical attack on the pumps and piping, or on the mold housing and internal plates. Further, spraying the solution against a mold tube wall that is too hot can simply cause the solution to flash to vapor, defeating proper retention time of the solution on the precipitate layer and preventing it from dissolving the precipitate. Inappropriate solution concentration can also lead to contamination of the cooling water and/or damage to other components of the system, or can require an excessively long retention time in order to dissolve the precipitate.

BRIEF DESCRIPTION OF THE DRAWINGS

The foregoing objects and advantages of the invention will become apparent from the following detailed description when considered in conjunction with the accompanying drawings, wherein like reference characters designate like parts throughout the several views, and wherein:

FIG. 1 is a diagrammatic sectional view of a portion of a mold tube wall, showing a layer of precipitate thereon;

FIG. 2 is a fragmentary, diagrammatic sectional view of a portion of a mold tube wall not having any precipitate layer thereon, and showing schematically a high heat transfer rate therethrough;

FIG. 3 is a view similar to FIG. 2, of a prior art device, with a layer of precipitate on the wall of the mold tube, and showing schematically a lower heat transfer rate through the mold tube wall;

FIG. 4 is a composite diagrammatic sectional view of a mold tube, showing a prior art device in the right hand side of the figure in which a layer of precipitate on the mold tube wall has prevented adequate heat transfer through the mold, resulting in "break-out" of the molten core of the cast strand as it exits the mold tube;

DETAILED DESCRIPTION OF THE PREFERRED EMBODIMENTS

Figure 5:
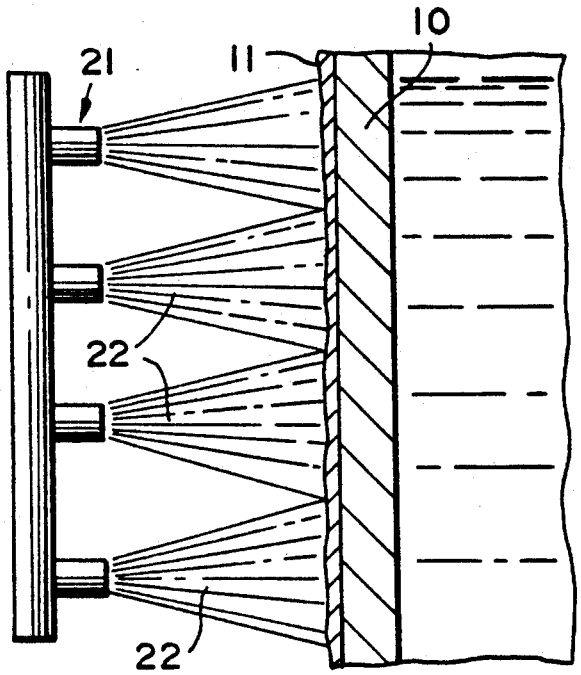
FIG. 5 is a diagrammatic side view of a portion of a mold tube and apparatus in accordance with the invention for spraying a chemical solution against the precipitate layer to dissolve it.

Referring more specifically to the drawings, a fragmentary cross-section of a mold tube 10 is shown in FIG. 1, with a layer of precipitate on its outside surface being diagrammatically represented at 11. This layer of precipitate typically comprises compounds of calcium and magnesium and forms an insulating barrier to transfer of heat from the molten steel 12, through the mold tube wall and into the sprays of coolant water 13.

As further diagrammatically represented in FIG. 2, when there is no layer of precipitate on the mold tube 10, the rate of heat transfer from the molten steel 12 through the mold is relatively high, as represented by the arrows HT. On the other hand, when precipitate has built up, as represented at 11 in FIG. 3, the rate of heat transfer is impeded and is relatively slow, as represented by arrows HT'.

The composite view in FIG. 4 demonstrates the effect that a layer of precipitate on the mold tube can have on the cast steel strand 14 as it advances through the mold in the direction of arrow $P_1$. Thus, in the left-hand side of this figure, the mold tube 10 is free of any precipitate build-up and the rate of heat transfer through the mold tube wall is sufficient to enable the outer shell 15 of the cast steel strand to harden to a depth adequate for confining the molten steel core 12. Conversely, the mold tube 10 on the right-hand side of this figure has a layer of precipitate 11 thereon, which impedes heat transfer through the mold tube wall and results in, inadequate cooling of the cast steel strand, whereby the shell 15' does not solidify to a sufficient depth to support the molten steel core 12, and a "break-out" 16 of the molten core may occur.

Figure 6:
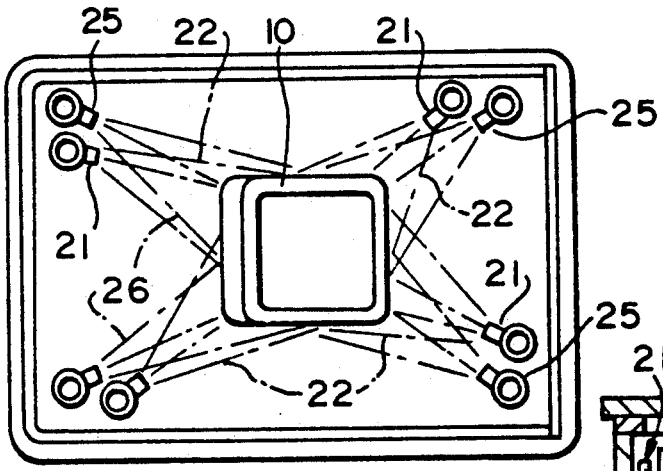
FIG. 6 is a diagrammatic longitudinal sectional view of a spray-cooled mold having an arrangement of spray nozzles for spraying coolant water against the mold tube, and including an arrangement of spray nozzles for spraying a chemical solution against the mold tube to dissolve any precipitate layer thereon.
Figure 7:
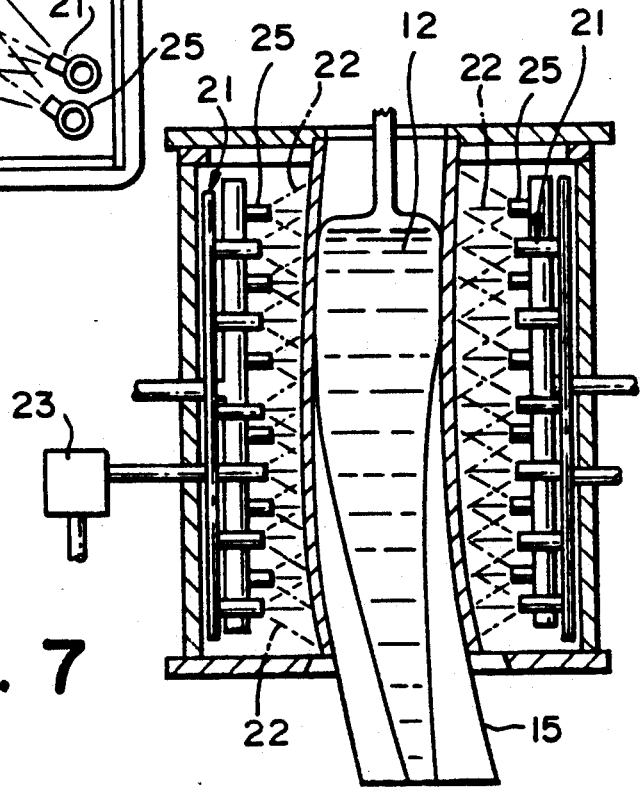
FIG. 7 is a diagrammatic transverse sectional view of the apparatus of FIG. 6.

An apparatus 20 for solving this problem is illustrated in FIGS. 5, 6 and 7, and comprises a system of spray nozzles 21 arranged in predetermined spaced relationship to one another and to the mold tube 10 for spraying a chemical solution 22 against the outer surface of the mold tube to dissolve the precipitate layer 11 on the mold tube and thus maintain a relatively high rate of heat transfer through the tube wall. Since the precipitate layer most often comprises compounds of calcium and magnesium, the cleaning spray may comprise an acidic solution of muriatic acid and water, or other solution suitable for dissolving the precipitate layer. In some instances it may be necessary to employ a basic solution, depending upon the composition of the precipitate layer.

Regardless of the chemical composition of the solution used to dissolve the precipitate layer, it is important that the solution remain in contact with the precipitate layer for an adequate retention time to dissolve the layer. This retention time varies with the precipitate layer thickness and generally correlates to the following table I.

TABLE I

| Precipitate Thickness (in.) | Solution Retention Time (mins.) |
|---|---|
| .003-.008 | 0.317 |
| >.008-≦.011 | 0.817 |
| >.011-≦.057 | 1.622 |
| >.057-≦.089 | 1.957 |
| >.089-≦.100 | 2.202 |

In addition to the essential retention times for the solution to remain on the precipitate layer in order to effect dissolution, as given in the table above, there are several other critical parameters. These include spray pressure and spray angle of the cleaning solution, spacing of the cleaning spray nozzles from one another and from the mold tube, and concentration of the cleaning solution. These parameters are related to the temperature of the copper mold tube wall, which therefore constitutes another essential parameter which must be followed for successful implementation of the invention.

As seen in FIGS. 5, 6 and 7, the spray nozzles 21 for the cleaning solution 22 are organized similarly to the coolant spray nozzles 25 for spraying a coolant 26 against the mold tubes as more fully described in applicant's earlier U.S. Pat. No. 4,494,594, for example, the disclosure of which is incorporated by reference herein. The cleaning spray nozzles 21 are spaced among the coolant spray nozzles for covering the entire outer surface of the mold tube with cleaning solution 22, and operation of the coolant spray nozzles as well as the cleaning spray nozzles may be controlled by a suitable control means 23, represented schematically in the drawings. For instance, it is possible to operate the cleaning spray nozzles to spray a cleaning solution against the mold tube even during a casting operation. Preferably, however, the cleaning operation takes place following a casting operation and when the mold tube has cooled to between 60° F. and 200° F. If the mold tube wall temperature is less than about 60° F., the dissolution time of the precipitate can be considerably higher than the values given in table I. Keeping the dissolution time within the ranges given in table I is important because casting operations must preferably cease during dissolution time. A prolonged dissolution time results in production delays and may lead to equipment breakdown. On the other hand, a mold tube wall temperature in excess of about 200° F. will result in a considerable percentage of the cleaning solution flashing to vapor, so that the cleaning solution does not remain in contact with the precipitate long enough to effect dissolution. This also prolongs the dissolution time.

The concentration of the cleaning solution must also be maintained in the range of from about 8% to about 65% in order to initiate fast and complete precipitate dissolution while at the same time not being too caustic or corrosive for the mold machine components, or contaminating the system environment, i.e., cooling water, etc.

The pressure of the cleaning solution must also be maintained within a specific range for proper functioning of the system. Applicant has discovered that if the system pressure is too high, the cleaning solution will splash back off of the copper mold tube and will not adhere to the precipitate layer. Excessive pressure will also result in excess cleaning solution flowing into the cooling water system, causing it to become too acidic. A proper range of spray pressure is from about 8 psig to about 36 psig, at the nozzle, for the cleaning solution to adhere to the precipitate layer for dissolution of the precipitate and to prevent splash-back of the solution.

If the included angle of the spray of cleaning solution from a nozzle is greater than about 128° the solution will reflect or glance off the precipitate and will not adhere to the precipitate long enough to effect dissolution. Likewise, if the spray angle is less than about 26° the stream will impact the mold tube with excessive force and will splash ineffectually off the precipitate. In addition, this splash-back subjects the remaining system components of the mold machine to chemical attack by the cleaning solution. Either condition will also result in waste of the cleaning solution.

The spray nozzles must also be spaced relative to one another and to the mold tube to insure complete and uniform coverage of the precipitate layer. Thus, the nozzles should be spaced no further than about 4 inches from the mold tube surface; and, they should be no closer to one another than about 1 inch nor farther apart than about 3 inches, as measured center-to-center.

A spray cooled mold equipped with the spray cleaning system described above can operate much more effectively than has heretofore been possible, and need not be shut down for periodic cleaning of precipitate from the mold tube. Moreover, since the precipitate can be cleaned from the mold tube almost immediately between casting operations, the precipitate is much easier to dissolve. Dissolution is also much quicker and more efficient than mechanical polishing, as practiced in the prior art.

In operation, a casting operation would be completed and the mold tube allowed to cool to between 60° F. and 200° F. The cleaning solution would then be sprayed against the precipitate layer on the outer surface of the mold tube and permitted to remain there for the retention time as identified in table I. The cooling spray system could then be operated briefly to wash or rinse the cleaning solution from the mold tube, after which a subsequent casting operation could be immediately started. The entire cleaning operation takes only minutes and does not require expensive and time consuming labor, downtime, etc.

If necessary, the cleaning solution could even be sprayed against the mold tube during a casting operation in order to reduce or remove a precipitate layer that may be impairing the quality of a cast strand.

While the invention has been shown and described in detail, it is obvious that this invention is not to be considered as being limited to the exact form disclosed, and that changes in detail and construction may be made therein within the scope of the invention, without departing from the spirit thereof.

What is claimed is:

1. In a mold having a mold tube for casting molten metal, and means for directing a coolant fluid against the mold tube for cooling it and the metal being cast therein, the improvement comprising:

means for applying a chemical solution against the outside surface of the mold tube, in situ, for dissolving precipitates therefrom while the mold tube remains in place in the mold.

2. A mold as claimed in claim 1, wherein:

the means for applying a chemical solution comprises spray nozzle means for spraying the solution against the mold tube.

3. A mold as claimed in claim 2, wherein:

the mold is a continuous casting machine; and the means for directing a coolant fluid against the mold tube comprises spray nozzles for spraying a coolant fluid against the mold tube during a casting operation.

4. A mold as claimed in claim 3, wherein:

the spray nozzle means for spraying a chemical solution against the mold tube comprise a plurality of spray nozzles spaced around the mold tube and arranged to cover the entire outer surface of the mold tube with the solution.

5. A mold as claimed in claim 4, wherein:

the spray nozzles for the solution are spaced from one another in the range of from about one inch to about three inches apart, and are spaced from the surface of the mold tube no more than about four inches.

6. A mold as claimed in claim 4, wherein:

the included angle of the spray from each of the solution spray nozzles is in the range of from about 26° to about 128°.

7. A mold as claimed in claim 4, wherein:

the pressure of the sprayed solution, at the nozzle, is in the range of from about 8 psig to about 36 psig.

8. A mold as claimed in claim 4, wherein:

the chemical solution comprises a mixture of active agent and carrier, with the concentration of active agent to carrier being in the range of from about 8% to about 65%.

9. A mold as claimed in claim 4, wherein:

the temperature of the mold tube wall when the chemical solution is sprayed thereagainst is in the range of from about 60° F. to about 200° F.

10. A mold as claimed in claim 5, wherein:

the included angle of the spray from each of the solution spray nozzles is in the range of from about 26° to about 128°;

the pressure of the sprayed solution, at the nozzle, is in the range of from about 8 psig to about 36 psig;

the chemical solution comprises a mixture of active agent and carrier, with the concentration of active agent to carrier being in the range of from about 8% to about 65%; and the temperature of the mold tube wall when the chemical solution is sprayed thereagainst is in the range of from about 60° F. to about 200° F.

11. A mold as claimed in claim 1, wherein:

the chemical solution comprises an active agent and a carrier, the active agent comprises muriatic acid and the carrier comprises water.

12. A mold as claimed in claim 11, wherein:

the concentration of active agent to carrier in the solution is in the range of from about 8% to about 65%.

13. A method of removing precipitate from the outer surface of a mold tube in a metal casting machine, comprising the steps of:

applying a chemical solution, in situ, to the precipitate on the mold tube to dissolve and remove the precipitate while leaving the mold tube in place in the metal casting machine.

14. A method as claimed in claim 13, wherein:

the chemical solution is applied by spraying it against the mold tube while the mold tube remains in place in the casting machine.

15. A method as claimed in claim 14, wherein:

the metal casting machine is a continuous casting machine in which sprays of water are used to cool the mold tube and solidify the metal being cast, and said sprays of water are used to rinse the chemical solution from the mold tube after the precipitate is dissolved.

* * * * *